US009538840B2

(12) United States Patent
Yang

(10) Patent No.: US 9,538,840 B2
(45) Date of Patent: Jan. 10, 2017

(54) FOLDING CHAIR AND SIDE TABLE THEREOF

(71) Applicant: ZHEJIANG HENGFENG TOP LEISURE CO., LTD., Hangzhou (CN)

(72) Inventor: Baoqing Yang, Hangzhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 59 days.

(21) Appl. No.: 14/553,339

(22) Filed: Nov. 25, 2014

(65) Prior Publication Data

US 2015/0359332 A1 Dec. 17, 2015

(30) Foreign Application Priority Data

Jun. 17, 2014 (CN) ..... 2014 2 0322592 U

(51) Int. Cl.
*A47B 3/14* (2006.01)
*A47B 83/02* (2006.01)
(Continued)

(52) U.S. Cl.
CPC ..... *A47B 3/14* (2013.01); *A47B 83/02* (2013.01); *A47C 4/00* (2013.01); *A47C 4/283* (2013.01); *A47C 7/70* (2013.01); *A47B 23/02* (2013.01)

(58) Field of Classification Search
CPC ..... A47C 7/70; A47C 4/00; A47C 4/283; A47B 83/02; A47B 23/02; A47B 13/083; A47B 3/14
(Continued)

(56) References Cited

U.S. PATENT DOCUMENTS 289,384 A * 12/1883 Byrkit ..... A47B 23/042 248/454
818,917 A * 4/1906 Ruger ..... A47C 7/70 297/173
(Continued)

FOREIGN PATENT DOCUMENTS

CN 2115008 9/1992
CN 2677503 2/2005

OTHER PUBLICATIONS

European Patent Office, European Patent Search corresponding to International Application No. EP13151986.0-1656, Apr. 25, 2014, 5 pp.
(Continued)

*Primary Examiner* — Milton Nelson, Jr.
(74) *Attorney, Agent, or Firm* — Fitch, Even, Tabin & Flannery LLP

(57) ABSTRACT

A side table for a folding chair is provided according to the present application, which includes a vertical tube configured to be fixed to a chair frame of the folding chair; a bent tube having a first bent portion and a second bent portion which are fixedly connected, and the first bent portion being inserted in the vertical tube; a side table board rotatably arranged on the second bent portion; a first locking mechanism configured to fix the first bent portion in an axial direction and a circumferential direction of the vertical tube; and a second locking mechanism configured to fix the side table board to the second bent portion. The side table according to the present application may support objects, facilitate placing objects, such as a cup, for the user, thus is convenient for the user. A folding chair having the side table is easy to use.

3 Claims, 10 Drawing Sheets

(51) Int. Cl.

| | |
|---|---|
| ***A47C 7/70*** | (2006.01) |
| ***A47C 4/00*** | (2006.01) |
| ***A47C 4/28*** | (2006.01) |
| *A47B 23/02* | (2006.01) |

(58) Field of Classification Search
USPC ..... 297/173
See application file for complete search history.

(56) References Cited

U.S. PATENT DOCUMENTS

| | | | | |
|---|---|---|---|---|
| 5,653,499 | A * | 8/1997 | Goodall | A47C 7/70 297/170 |
| 6,951,327 | B1 | 10/2005 | Seo | |
| 8,820,825 | B2 | 9/2014 | Yang | |
| 2007/0131149 | A1* | 6/2007 | Mayben | A47B 17/036 108/97 |
| 2007/0216201 | A1* | 9/2007 | Hart | A47C 4/283 297/162 |
| 2010/0237664 | A1 | 9/2010 | Grace | |
| 2012/0055378 | A1* | 3/2012 | Stamper | A47C 4/283 108/50.11 |
| 2012/0175917 | A1 | 7/2012 | Chen | |
| 2014/0167473 | A1 | 6/2014 | Yang | |

OTHER PUBLICATIONS

U.S. Patent and Trademark Office, Quayle Office Action, Feb. 21, 2014, 10 pp.

* cited by examiner

FOLDING CHAIR AND SIDE TABLE THEREOF

CROSS-REFERENCE TO RELATED APPLICATIONS

This application claims the benefit of priority to Chinese Patent Application No. 201420322592.4 titled "FOLDING CHAIR AND SIDE TABLE THEREOF", filed with the Chinese State Intellectual Property Office on Jun. 17, 2014, the entire disclosure of which is incorporated herein by reference.

TECHNICAL FIELD

The present application relates to the technical field of outdoor goods, and in particular to a side table of a folding chair and a folding chair.

BACKGROUND

Folding chair is a portable and foldable chair, which is convenient to move and saves space, thus is a necessity for outdoor recreation activities.

Referring to FIG. 1, a conventional folding chair includes a chair frame 10 and a cloth cover. The chair frame includes two groups of chair legs, and two U-shaped hinge members 14 adapted to connect the two groups of chair legs. Each group of the chair legs includes a front chair leg 13 and a rear chair leg 11, and the rear chair leg 11 is longer than the front chair leg 13. In each group of the chair legs, the front chair leg 13 is connected to the rear chair leg 11 via a reinforcing rod 12. Each U-shaped hinge member 14 includes two vertical rods and a cross rod connected with the two vertical rods, and the two vertical rods of one U-shaped hinge member 14 are respectively articulated to the two vertical rods of another U-shaped hinge member 14 at middle parts thereof. Two articulated vertical rods have free ends respectively articulated to the two front chair legs 13 (or the two rear chair legs 11), and have the other ends articulated to the two front chair legs 13 (or the two rear chair legs 11) via connecting rods 15. The cross rod of each U-shaped hinge member 14 is located above the vertical rods thereof. The cloth cover includes a seat surface supported at the cross rods of the two U-shaped hinge members 14 and a seat back supported at the rear chair legs 11.

The folding chair has advantages of portability and saving space. However, the folding chair can only provide a seat for a user, objects, such as a cup or tableware, need to be held by hand or placed on the ground when the user rests on the folding chair, which causes inconvenience to the user.

In conclusion, a technical problem to be solved presently by those skilled in the art is to provide an object supporting device of a folding chair and a folding chair having the same to facilitate placing objects, such as a cup, for the user.

SUMMARY

In view of this, a side table of a folding chair is provided according to the present application, which may support objects, and facilitate placing objects, such as a cup, for a user, thus is convenient for the user. A folding chair having the side table is further provided according to the present application, which is also convenient for the user.

The following technical solutions are provided according to the application.

A side table of a folding chair, includes:

a vertical tube configured to be fixed to a chair frame of the folding chair;

a bent tube having a first bent portion and a second bent portion which are fixedly connected, and the first bent portion being inserted in the vertical tube;

a side table board rotatably arranged on the second bent portion;

a first locking mechanism configured to fix the first bent portion in an axial direction and a circumferential direction of the vertical tube; and a second locking mechanism configured to fix the side table board to the second bent portion.

Preferably, in the side table, the first locking mechanism and the second locking mechanism are an integrated locking mechanism which includes:

a first damping block having a first end inserted in an end of the first bent portion and a second end provided with a notch, and an outer periphery of the second end of the first damping block being provided with external splines configured to cooperate with internal splines of the vertical tube;

a second damping block having a first end inserted in an end of the second bent portion and a second end provided with a notch, and an outer periphery of the second end of the second damping block being provided with external splines;

a position-limiting tube fixedly connected to the side table board, wherein the second end of the second damping block is located in the position-limiting tube, and an inner wall of the position-limiting tube is provided with internal splines configured to cooperate with the external splines of the second damping block;

a flexible pull rod inserted in the bent tube, wherein the flexible pull rod has one end provided with a first tapered pressing block configured to push the second end of the first damping block to expand to be in tight fit with the internal splines of the vertical tube, and has another end articulated to a cam lever;

a mounting sleeve fixedly arranged on the side table board, wherein a second tapered pressing block is slidably arranged in the mounting sleeve and is configured to push the second end of the second damping block to expand to be in tight fit the internal splines of the position-limiting tube, and the second tapered pressing block abuts against the cam lever; and a spring sleeved on the flexible pull rod, and having two ends respectively abutting against the first damping block and the second damping block.

Preferably, in the side table, the locking mechanism further includes a position-limiting assembly configured to limit a rotation angle of the side table board in a circumferential direction of the second bent portion. The position-limiting assembly includes a first position-limiting ring fixed outside the position-limiting tube, and a second position-limiting ring fixed outside the second bent portion; an end, facing the first position-limiting ring, of the second position-limiting ring is provided with a position-limiting notch, and an end, facing the second position-limiting ring, of the first position-limiting ring is provided with a position-limiting protrusion, and the position-limiting protrusion is located in the position-limiting notch.

Preferably, in the side table, the side table board includes a table top and a wrapping edge fixed at the periphery of the table top; the mounting sleeve is fixedly connected to the wrapping edge; and the position-limiting tube is fixedly connected to the mounting sleeve.

Preferably, in the side table, two ends of the flexible pull rod are each provided with a screw rod; the first tapered pressing block is fixed at the screw rod at one end of the flexible pull rod; and the second tapered pressing block is sleeved on the screw rod at the other end of the flexible pull rod.

Preferably, in the side table, a position-limiting flange is arranged at a middle portion of the first damping block, and a circumcircle of the position-limiting flange has a diameter larger than an inner diameter of the first bent portion.

Preferably, in the side table, the first locking mechanism and the second locking mechanism are an integrated locking mechanism which includes:

a flexible pull rod inserted in the bent tube;

a spring sleeved on the flexible pull rod and located in the bent tube;

a damping block having a first end inserted in an end of the first bent portion and a second end provided with a notch, and an outer periphery of the second end of the damping block being provided with external splines configured to cooperate with internal splines of the vertical tube;

a tapered pressing block arranged at a first end of the flexible pull rod, and configured to push the second end of the damping block to expand to be in tight fit with the internal splines of the vertical tube;

a cam lever articulated to a second end of the flexible pull rod, wherein, the cam lever is configured to pull the flexible pull rod along the bent tube when the cam lever is pulled, and the cam lever abuts against the side table board;

a positioning assembly arranged on the flexible pull rod, and configured to fix the side table board circumferentially when the cam lever is pulled; wherein the positioning assembly includes a circumferential locking block fixed on the flexible pull rod, and a locking member sleeved on the flexible pull rod; an end, close to the cam lever, of the locking member is provided with a receiving hole configured to cooperate with the circumferential locking block, and an end surface of this end of the locking member is provided with a rack arranged in a radial direction of the flexible pull rod; and a toothed block is fixed on the side table board and is configured to cooperate with the rack, and the cam lever is provided at a side, away from the locking member, of the toothed block; and a spring sleeved on the flexible pull rod, and having two ends respectively abutting against the damping block and the locking member.

Preferably, in the side table, a screw rod is fixed at the first end of the flexible pull rod, and the tapered pressing block has internal threads configured to cooperate with the screw rod; and a connecting pole articulated to the cam lever is fixed at the second end of the flexible pull rod.

Preferably, in the side table, the second locking mechanism includes:

a toothed wheel coaxially arranged with the second bent portion;

a fixing block fixedly arranged on the side table board and having a first receiving groove for receiving the toothed wheel, wherein, a side wall of the first receiving groove is provided with internal teeth configured to cooperate with the toothed wheel;

a locking member fixedly arranged at an end of the second bent portion, wherein an end surface of the locking member is provided with a second receiving groove, and a side wall of the second receiving groove is provided with internal teeth configured to cooperate with the toothed wheel;

a spring provided between the toothed wheel and a bottom surface of the second receiving groove and being abutted between the toothed wheel and the bottom surface of the second receiving groove; and a push button arranged at a side, away from the locking member, of the fixing block, and configured to push the toothed wheel to allow the toothed wheel to cooperate with the internal teeth of the first receiving groove and the internal teeth of the second receiving groove.

Preferably, in the side table, the first locking mechanism includes:

a cam lever articulated to the vertical tube via a rotation shaft;

a through hole arranged in the vertical tube at a position corresponding to a protruding portion of the cam lever; and a locking block arranged in the through hole and located between a cam of the cam lever and an outer wall of the first bent portion.

A folding chair, includes a chair frame, and further includes a side table according to any one of the above technical solutions.

A side table of a folding chair is provided according to the present application, which includes a vertical tube, a bent tube, a side table board, and a locking mechanism. The vertical tube is configured to be fixed to a chair frame of the folding chair. The bent tube includes a first bent portion and a second bent portion which are fixedly connected. The first bent portion is inserted in the vertical tube, and is rotatable in the vertical tube and is slidable in an extending direction of the vertical tube. The side table board is rotatably arranged on the second bent portion. The locking mechanism is configured to fix the side table board on the second bent portion, and fix the first bent portion in the vertical tube axially and circumferentially.

When using the side table according to the present application, the side table is rotated to an appropriate angle, and at the same time, the first bent portion is adjusted to be at an appropriate height and an appropriate angle in the vertical tube, and the side table and the first bent portion are locked by the locking mechanism. When retracting the side table according to the present application, the locking mechanism is unlocked to unlock the side table board in the circumferential direction of the second bent portion, and meanwhile, to unlock the first bent portion in an axial direction and a circumferential direction of the vertical tube.

The side table according to the present application is capable of supporting objects, facilitating placing object, such as a cup, for the user, thus is convenient for the user.

In addition, in the side table according to the present application, the locking mechanism may control the unlocking or locking of the side table board in the circumferential direction of the second bent portion, and at the same time control the unlocking or locking of the first bent portion in the axial direction and the circumferential direction of the vertical tube, which may facilitate operation for the user, and is more convenient for the user.

A folding chair is further provided according to the present application, which is provided with the above side table, thus is convenient for the user.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

REFERENCE NUMERALS IN FIGS. 2 TO 10

Figure 1:
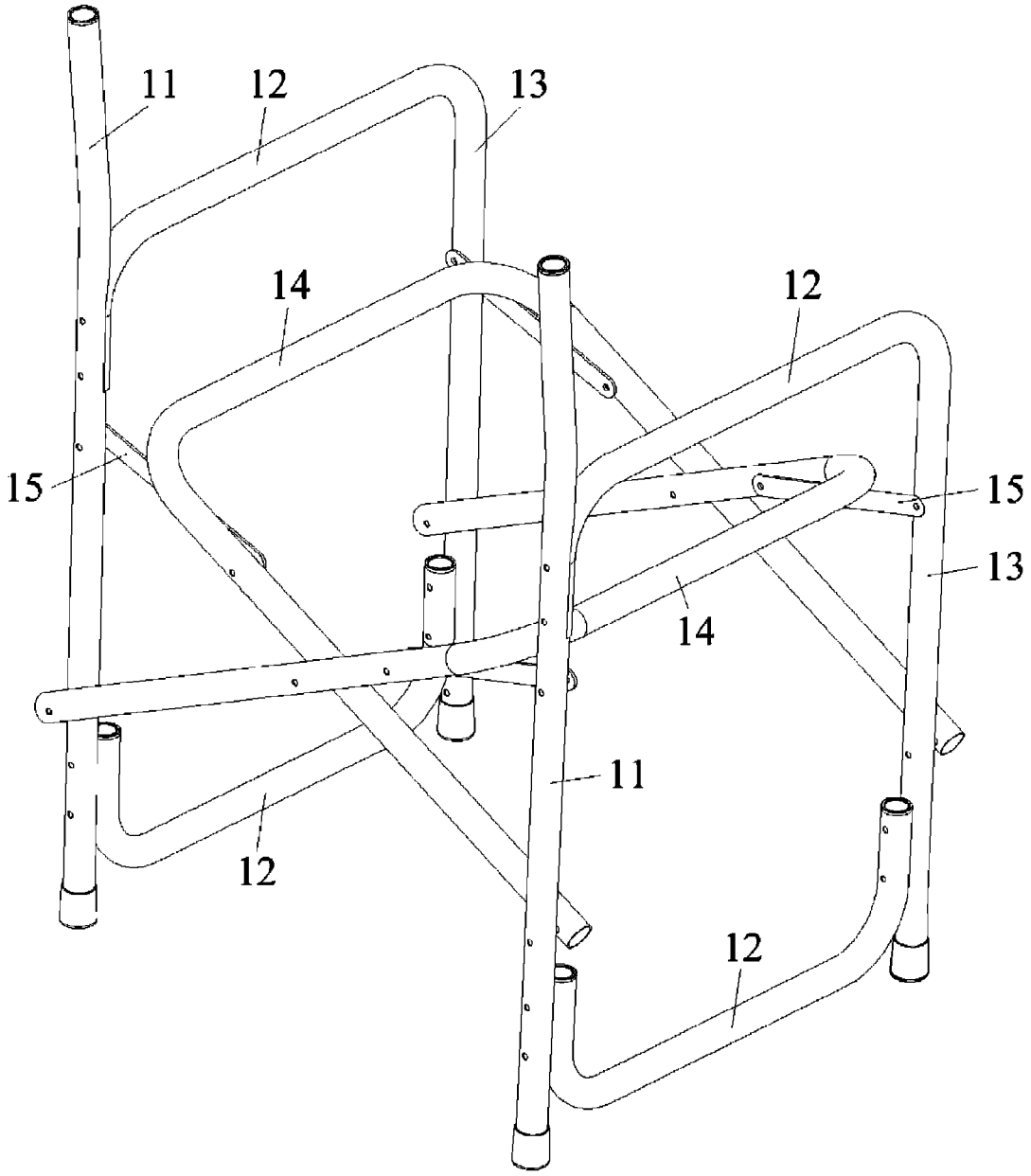
FIG. 1 is a schematic view showing the structure of a chair frame of a folding chair in the conventional technology.
Figure 2:
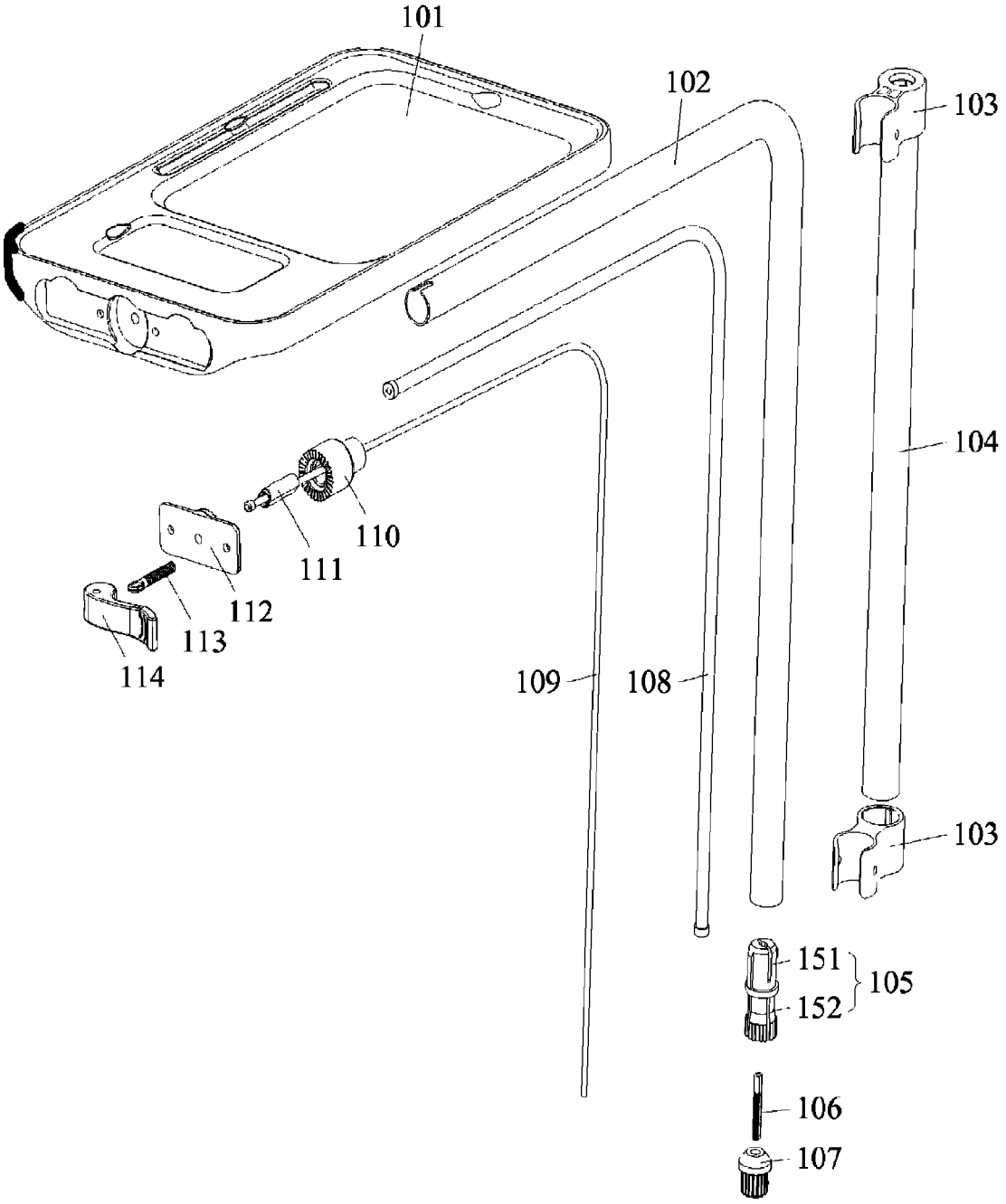
FIG. 2 is an exploded view of a side table according to an embodiment of the present application.
Figure 3:
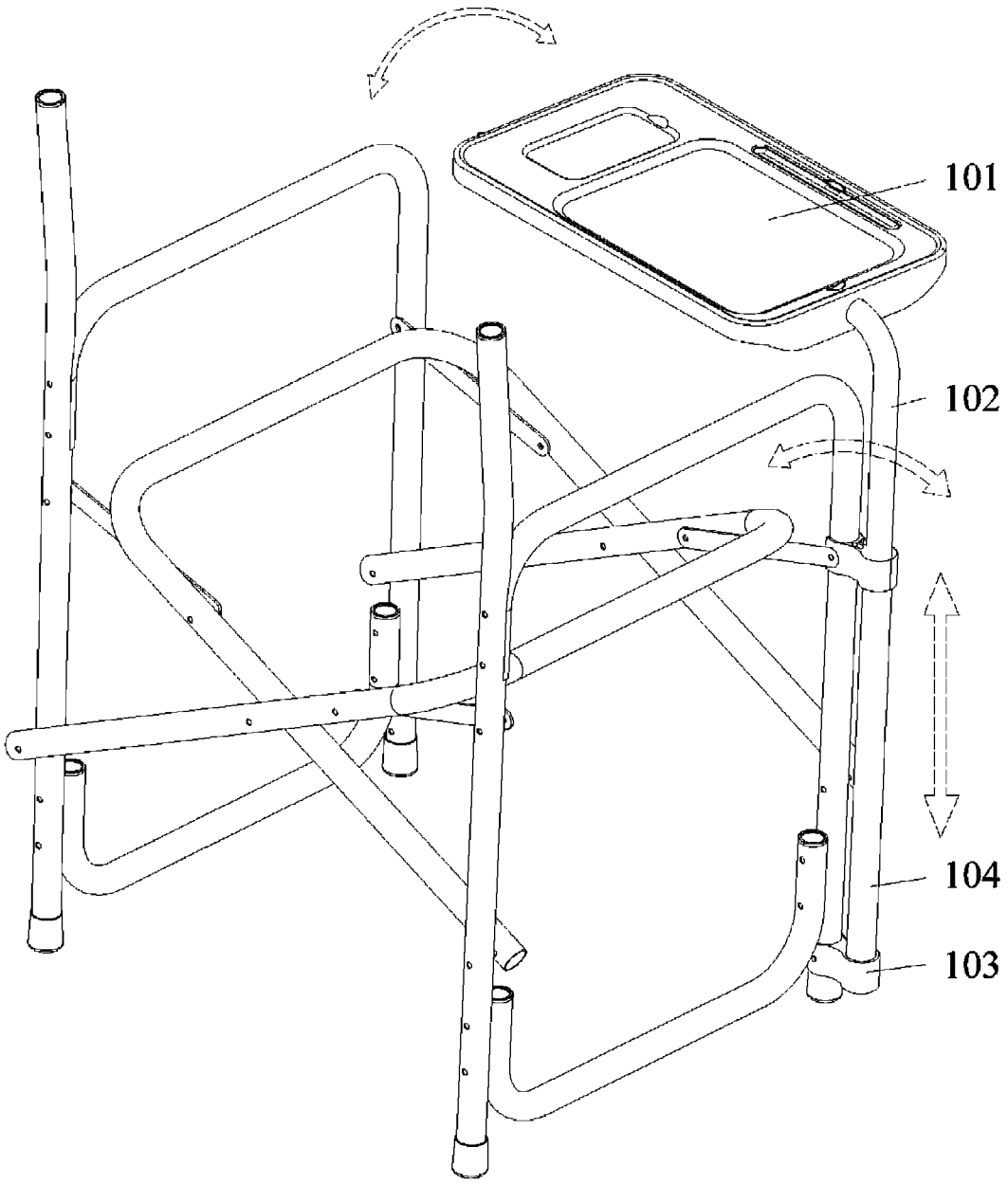
FIG. 3 is a schematic view showing the structure of the side table of FIG. 2 in a using state.
Figure 4:
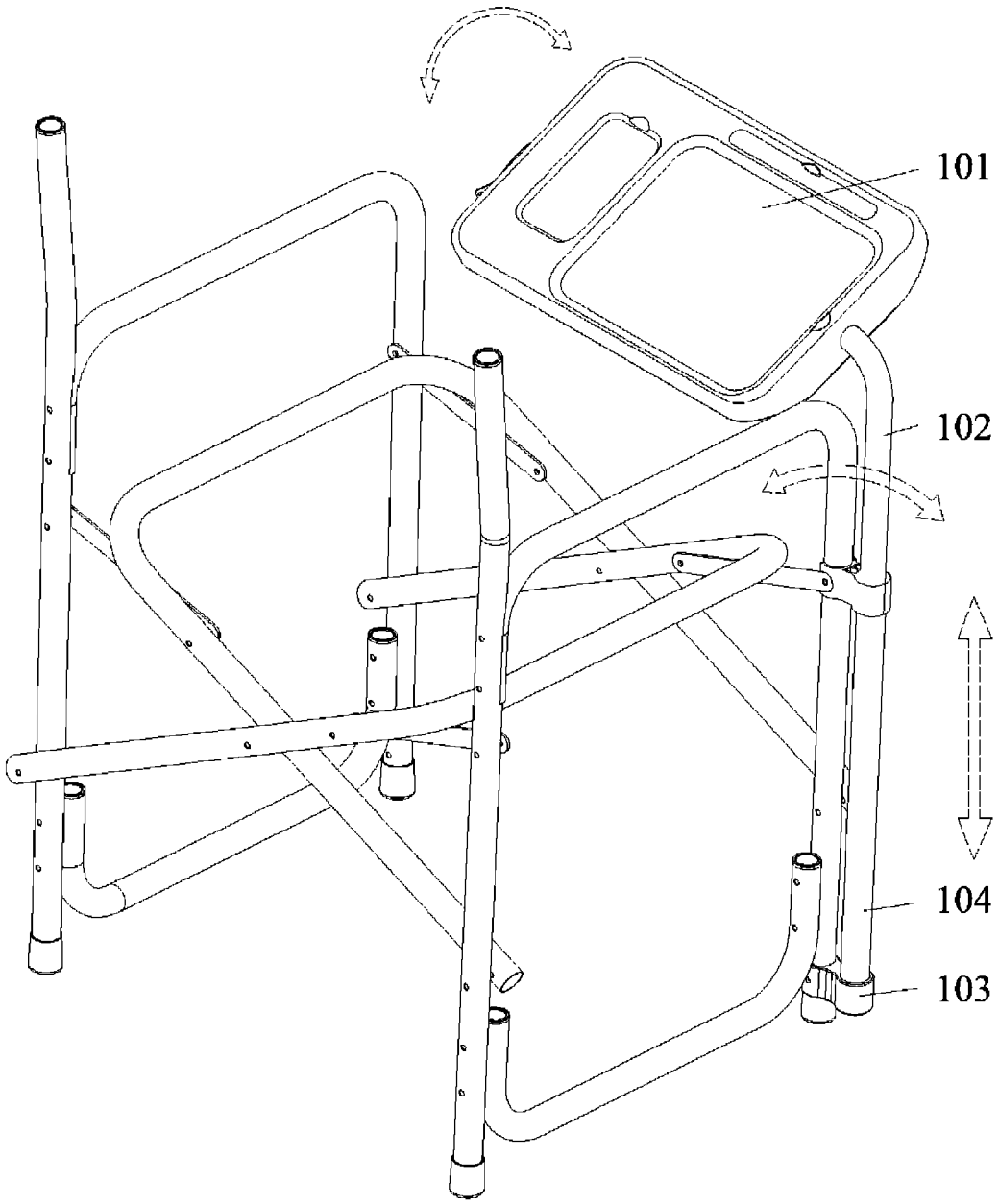
FIG. 4 is a schematic view showing a step of turning over a table top when the side table of FIG. 2 is to be retracted.
Figure 5:
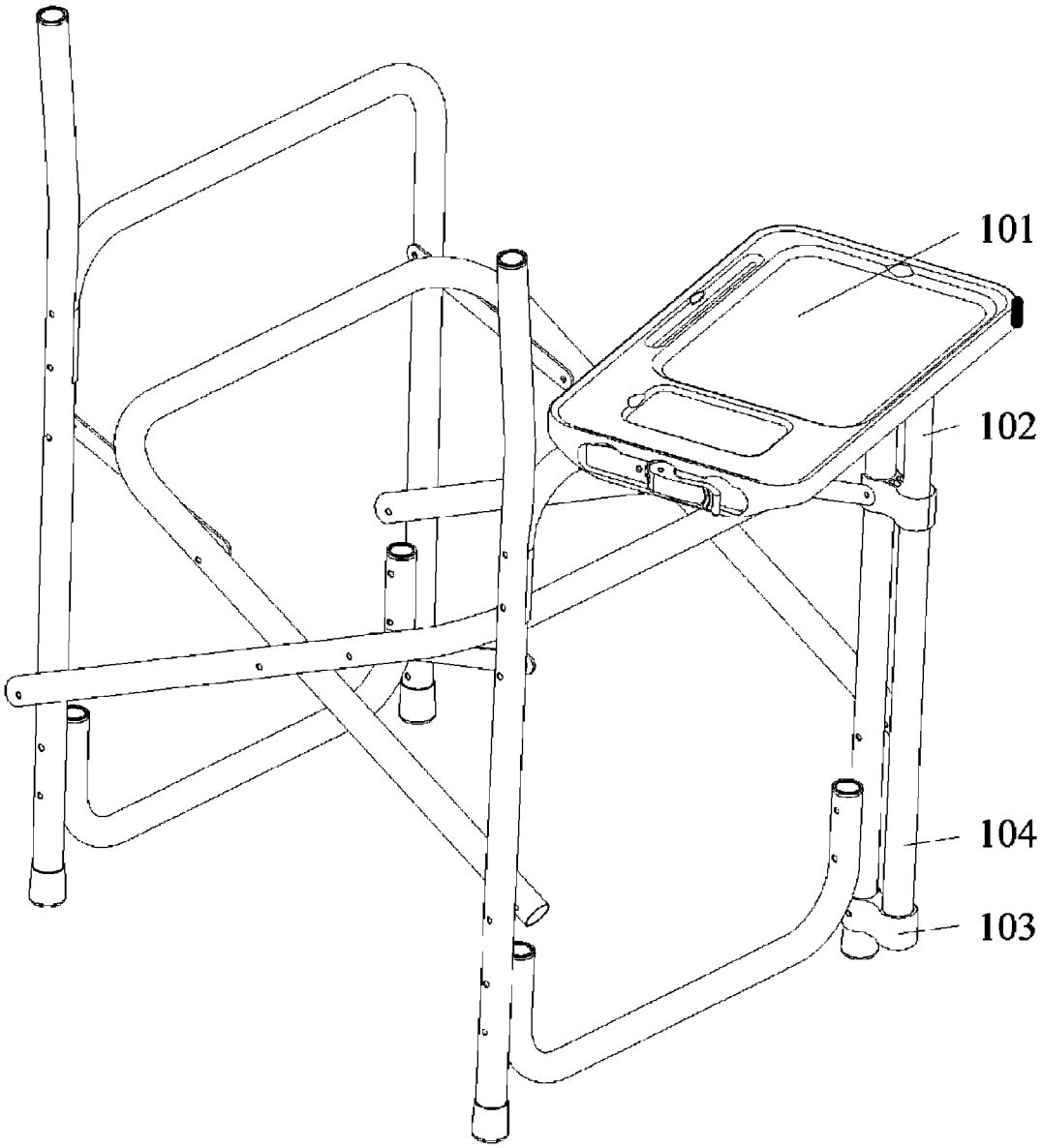
FIG. 5 is a schematic view showing a step of the table top being rotated to one side of a chair frame by a bent tube of the side table after the step in FIG. 4.
Figure 6:
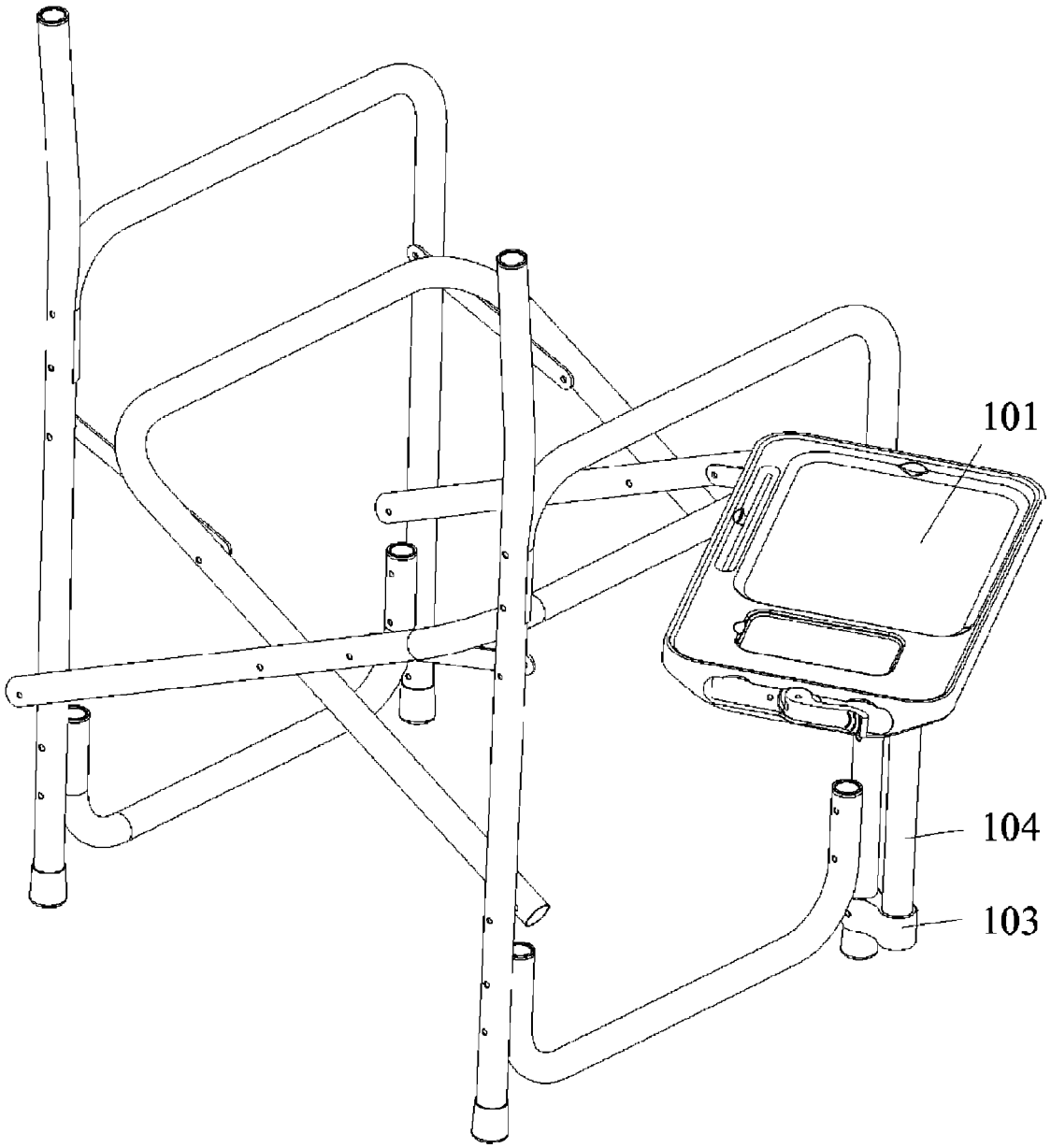
FIG. 6 is a schematic view showing a step of the bent tube of the side table falling into a bottom of a vertical tube after the step in FIG. 5.
Figure 7:
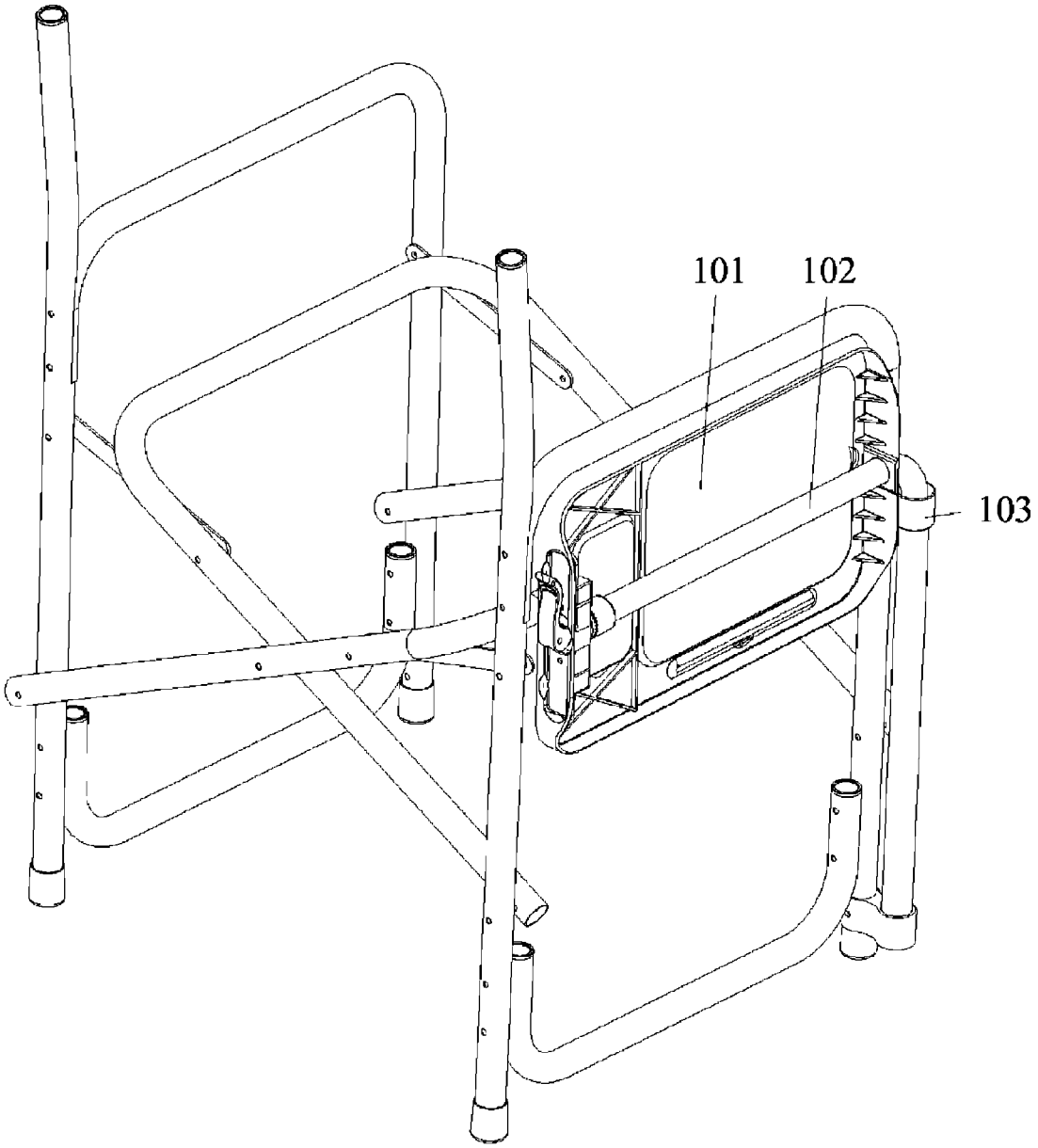
FIG. 7 is a schematic view showing a step of the table top being fastened and received at the side of the chair frame after the step in FIG. 6.

| | |
|---|---|
| 101 side table board, | 102 bent tube, |
| 103 fixing clip, | 104 vertical tube, |
| 105 damping block, | 151 mounting portion; |
| 152 deformable portion, | 106 screw rod, |
| 107 tapered pressing block, | 108 spring, |
| 109 flexible pull rod, | 110 locking member, |
| 111 circumferential locking block, | 112 toothed block, |
| 113 connecting pole, | 114 cam lever; |
| 201 second tapered pressing block, | 202 mounting sleeve, |
| 203 position-limiting tube, | 204 first position-limiting ring, |
| 205 second damping block, | 206 second position-limiting ring, |
| 207 first damping block, | 208 first tapered pressing block; |
| 301 push button, | 302 fixing block, |
| 303 toothed wheel, | 304 spring, |
| 305 locking member, | 306 tube casing, |
| 307 mounting lug, | 308 guide block; and |
| 309 locking block. | |

DETAILED DESCRIPTION

A side table of a folding chair is provided according to embodiments of the present application, which may support objects, and facilitate placing objects, such as a cup, for a user, thus is convenient for the user. A folding chair having the side table is further provided according to embodiments of the present application, which is also convenient for the user.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Reference is made to FIGS. 2 to 10, a side table of a folding chair is provided according to embodiment of the present application, which includes a vertical tube 104, a bent tube 102, a side table board, a first locking mechanism and a second locking mechanism. The vertical tube 104 is configured to be fixed to a chair frame of the folding chair. The bent tube 102 includes a first bent portion and a second bent portion which are fixedly connected and are in communication with each other, and the first bent portion and the second bent portion form a right angle shape. The first bent portion is inserted in the vertical tube 104, and is rotatable in the vertical tube 104 and is slidable in an extending direction of the vertical tube 104. The side table board is rotatably arranged on the second bent portion. The locking mechanisms are configured to fix the side table board on the second bent portion, and fix the first bent portion in the vertical tube 104 axially and circumferentially.

When using the side table according to the present application, the side table is rotated to an appropriate angle and then locked by the second locking mechanism, and the first bent portion is adjusted to be at an appropriate height and an appropriate angle in the vertical tube 104, and then is locked by the first locking mechanism. When retracting the side table according to the present application, the first locking mechanism and the second locking mechanism are unlocked to unlock the side table board 101 in the circumferential direction of the second bent portion, and meanwhile, to unlock the first bent portion in an axial direction and a circumferential direction of the vertical tube 104.

The side table according to the present application is capable of supporting objects, facilitating placing object, such as a cup, for the user, thus is convenient for the user.

Figure 8:
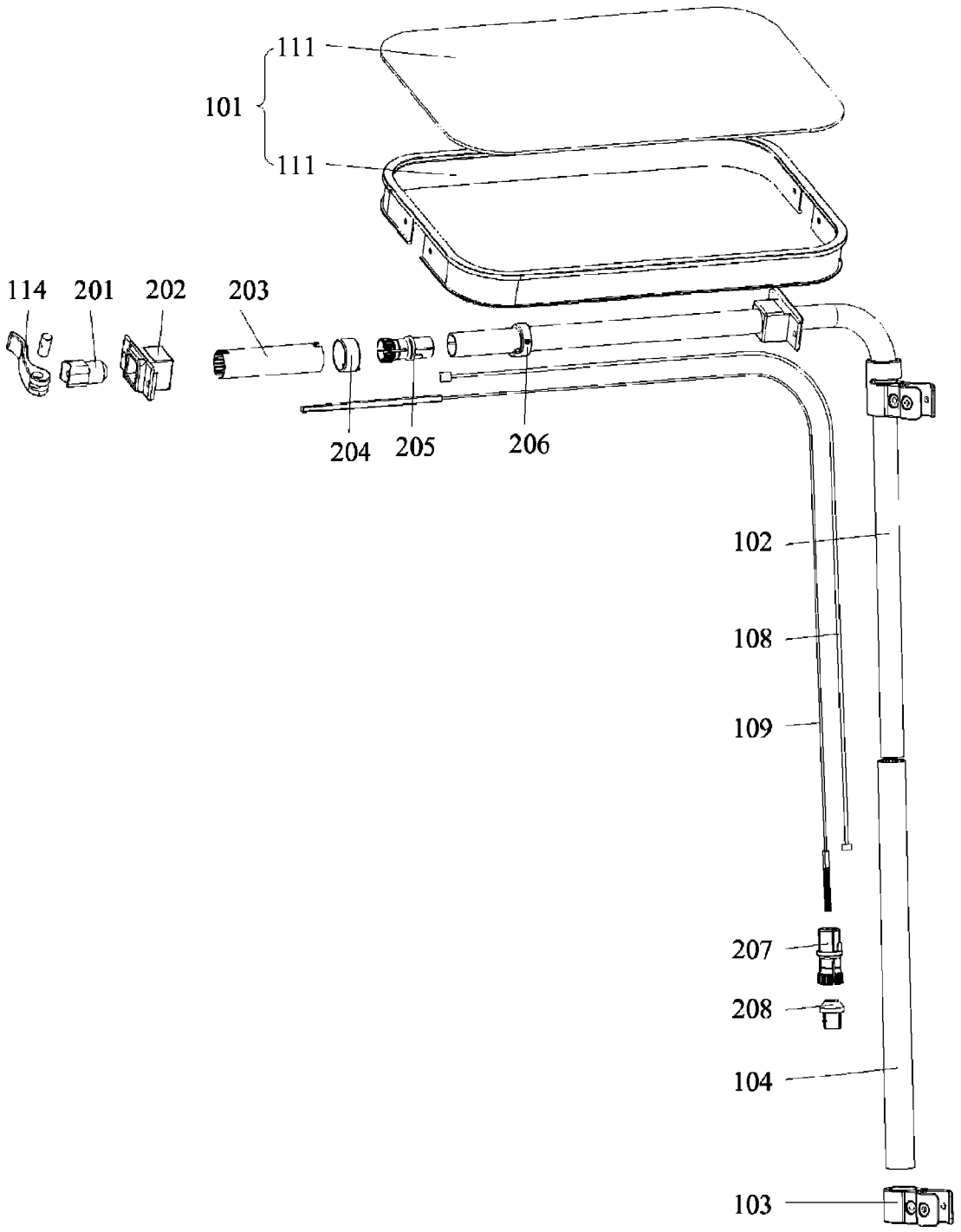
FIG. 8 is an exploded view of another side table according to an embodiment of the present application.

As shown in FIG. 8, in a first embodiment, the first locking mechanism and the second locking mechanism are an integrated locking mechanism, that is, in the side table according to the present application, the locking mechanism may control the unlocking or locking of the side table board 101 in the circumferential direction of the second bent portion, and at the same time control the unlocking or locking of the first bent portion in the axial direction and the circumferential direction of the vertical tube 104, which may facilitate operation for the user, and is more convenient for the user.

In the side table according to the above embodiment, the integrated locking mechanism may be configured to have the following structures.

Referring to FIG. 8, the locking mechanism includes a first damping block 207, a second damping block 205, a position-limiting tube 203, a flexible pull rod 109, a second tapered pressing block 201 and a spring 108. The first damping block 207 has a first end fixedly inserted in one end of the first bent portion, and a second end provided with a notch. An outer periphery of the second end of the first damping block 207 is provided with external splines for cooperating with internal splines of the vertical tube 104. The second damping block 205 has a first end fixedly inserted in one end of the second bent portion, and a second end provided with a notch. An outer periphery of the second end of the second damping block 205 is provided with external splines. The position-limiting tube 203 is fixedly connected to the side table board, and the second end of the second damping block 205 is located inside the position-limiting tube 203. The position-limiting tube 203 is provided with internal splines for cooperating with the external splines of the second damping block 205. The flexible pull rod 109 is inserted in the bent tube 102. One end of the flexible pull rod 109 is provided with a first tapered pressing block 208 configured to push the second end of the first damping block 207 to expand to be in tight fit with the internal splines of the vertical tube 104, another end of the flexible pull rod 109 is articulated with a cam lever 114, and the cam lever 114 is located outside the bent tube 102. The second tapered pressing block 201 is slidably arranged in a mounting sleeve 202 of the side table board. Due to the sliding of the second tapered pressing block 201 with respect to the mounting sleeve 202, the second end of the second damping block 205 is pushed to expand to be in tight fit the internal splines of the position-limiting tube 203, thereby achieving the locking operation of the second locking mechanism. The mounting sleeve 202 is fixedly connected to the side table board. The second tapered pressing block 201 abuts against the cam lever 114, and the second tapered pressing block 201 is configured to push the second end of the second damping block 205 to expand to be in tight fit with the internal splines of the position-limiting tube 203. The spring 108 is inserted inside the bent tube 102, and is sleeved on the flexible pull rod 109, and has two ends abutting against the first damping block 207 and the second damping block 205 respectively. The cam lever 114 is configured to enable the first tapered pressing block 208 to push the second end of the first damping block 207 to expand, and at the same time, enable the second tapered pressing block 201 to push the second end of the second damping block 205 to expand.

When using the side table board according to this embodiment, firstly, the first bent portion is adjusted to an appropriate height in the axial direction of the vertical tube 104, and then is adjusted to be at an appropriate angle in the circumferential direction of the vertical tube 104, and then the side table board 101 is adjusted to be at an appropriate angle in the circumferential direction of the second bent portion. Next, the cam lever 114 is pulled to pull the flexible pull rod 109 out of the vertical tube 104, thereby enabling the first tapered pressing block 208 to push against the second end of the first damping block 207, and in this case, the second end of the first damping block 207 splits at the notch thereof, which further allows the second end of the first damping block 207 to expand to be in tight fit with the internal splines of the vertical tube 104, thereby fixing the first bent portion in the vertical tube 104 in the axial direction and the circumferential direction of the vertical tube 104. Meanwhile, the second tapered pressing block 201 is pushed into the position-limiting tube 203 by the cam lever 114 to abut against the second end of the second damping block 205, and the second end of the second damping block 205 splits at the notch thereof, which allows the second end of the second damping block 205 to expand to be in tight fit with the internal splines of the position-limiting tube 203, thereby fixing the side table board 101 in the circumferential direction of the second bent portion. Correspondingly, after the cam lever 114 is pulled, a distance between the first tapered pressing block 208 and the second tapered pressing block 201 along the passage inside the vertical tube 104 is shortened, thereby compressing the spring 108. When retracting the side table board according to this embodiment, the cam lever 114 is pulled reversely, the first tapered pressing block 208 is pushed away from the first damping block 207 by the spring 108, which disengages the external splines of the second end of the first damping block 207 from the internal splines of the vertical tube 104, thus the first bent portion is unlocked in the axial direction and the circumferential direction of the vertical tube 104. Meanwhile, the second tapered pressing block 201 is pushed away from the second damping block 205 by the spring 108, which disengages the external splines of the second end of the second damping block 205 from the internal splines of the position-limiting tube 203, thus the side table board 101 is unlocked in the circumferential direction of the second bent portion.

Further, in order to facilitate rotating a flat table top of the side table board 101 to the upper side of the chair for the user, the locking mechanism in the side table according to this embodiment further includes a position-limiting assembly configured to limit a rotation angle of the side table board 101 in the circumferential direction of the second bent portion. The position-limiting assembly includes a first position-limiting ring 204 fixed outside the position-limiting tube 203 and a second position-limiting ring 206 fixed outside the second bent portion. An end of the second position-limiting ring 206, which faces the first position-limiting ring 204, is provided with a position-limiting notch, an end of the first position-limiting ring 204, which faces the second position-limiting ring 206, is provided with a position-limiting protrusion, and the position-limiting protrusion is located in the position-limiting notch. Alternatively, the end of the second position-limiting ring 206, which faces the first position-limiting ring 204, is provided with a position-limiting protrusion, the end of the first position-limiting ring 204, which faces the second position-limiting ring 206, is provided with a position-limiting notch, and the position-limiting protrusion is located in the position-limiting notch.

In the side table according to this embodiment, the side table board 101 includes a table top and a wrapping edge fixed at the periphery of the table top. The position-limiting tube 203, the mounting sleeve 202, and the second bent portion are all located on the same board surface at one side of the table top, and a board surface at the other side of the table top is a working board surface for supporting objects. The mounting sleeve 202 may be fixedly connected to the table top. Preferably, the mounting sleeve 202 may be fixedly connected to the wrapping edge, and are fixedly connected to two connectors of the wrapping edge, to reduce the number of parts of the side table, and simplify the structure. The position-limiting tube 203 may be fixedly connected to the table top, and may also be fixedly connected to the mounting sleeve 202.

In the locking mechanism according to this embodiment, two ends of the flexible pull rod 109 are each provided with a screw rod. The first tapered pressing block 208 is fixed at the screw rod at one end of the flexible pull rod 109. The second tapered pressing block 201 is slidably sleeved on the screw rod at the other end of the flexible pull rod 109, and the cam lever 114 is articulated with this screw rod.

For facilitating fixation, in the above locking mechanism, the first end of the first damping block 207 is provided with multiple protruding strips, and a middle portion of the first damping block 207 is provided with a position-limiting flange arranged circumferentially. Correspondingly, an inner wall surface of the first bent portion is provided with long retaining grooves in the axial direction of the first bent portion. In assembling, the protruding strips are wedged in the long retaining grooves, and the first damping block 207 is being pushed into the first bent portion until the position-limiting flange is stuck at the end of the first bent portion. The second damping block 205 is preferably configured to have the same structure as the first damping block 207.

In a second embodiment, the integrated locking mechanism may also be configured to have the following structures.

Referring to FIGS. 2 to 7, the locking mechanism includes a flexible pull rod 109, a spring 108, a positioning assembly, and a damping block 105. The flexible pull rod 109 is inserted in the bent tube 102. The spring 108 is sleeved on the flexible pull rod 109, and is located inside the bent tube 102. The positioning assembly is arranged on the flexible pull rod 109, and includes a circumferential locking block 111 fixed on the flexible pull rod 109 and a locking member 110 sleeved on the flexible pull rod 109. One end of the locking member 110, which is close to the cam lever 114, is provided with a receiving hole configured to cooperate with the circumferential locking block 111, and an end surface of this end is provided with a rack arranged in a radial direction of the flexible pull rod 109. A toothed block 112 is fixed on the side table board 101 and is configured to cooperate with the rack, and the cam lever 114 is arranged at a side of the toothed block 112 away from the locking member 110. A tapered pressing block 107 is provided at a first end of the flexible pull rod 109, and is configured to push a second end of the damping block 105 to expand to be in tight fit with the internal splines of the vertical tube 104. The cam lever 114 is articulated to a second end of the flexible pull rod 109, and is configured to pull the flexible pull rod 109 out of the bent tube 102 or release the flexible pull rod 109 back into the bent tube 102 when it is being pulled, that is, by pulling the wrench 114, the flexible pull rod 109 may be moved along the bent tube 102. The cam lever 114 abuts against the side table board 101. The damping block 105 is located at an end of the first bent portion. The flexible pull rod 109 is pulled out of the bent tube 102 by pulling the cam lever 114, which enables the tapered pressing block 107 to push the second end of the damping block 105 to expand till the second end of the damping block 105 is deformed to cooperate with the internal splines of the vertical tube 104. The positioning assembly is configured to lock the side table board 101 in the circumferential direction of the second bent portion when the flexible tube 109 is pulled out of the bent tube 102 by the cam lever 114, and to unlock the side table board 101 and push the damping block 105 in a direction away from the first bent portion via the spring 108 when the flexible pull rod 109 is released back into the bent tube 102 by the cam lever 114.

It should be appreciated that, the inner wall of the vertical tube 104 and the second end of the damping block 105 may not be provided with splines, and instead, the second end of the damping block 105 may be pushed to expand by the tapered pressing block 107, which enables the outer wall of the damping block 105 to abut against the inner wall of the vertical tube 104, and due to the friction, the first bent portion may also be fixed inside the vertical tube 104 circumferentially and axially.

Further, for facilitating the mounting, a screw rod 106 is fixed at the first end of the flexible pull rod 109, and the tapered pressing block 107 has internal threads configured to cooperate with the screw rod 106; and a connecting pole 113 articulated with the cam lever 114 is fixed at the second end of the flexible pull rod 109.

The positioning assembly includes the circumferential locking block 111 fixed on the flexible pull rod 109, and the locking member 110 sleeved on the flexible pull rod 109. The first end of the locking member 110 is pushed against by the spring 108, and the second end thereof is provided with the receiving hole configured to cooperate with the circumferential locking block 111. The circumferential locking block 111 is located in the receiving hole, to prevent the locking member 110 from rotating in the circumferential direction of the flexible pull rod 109. The end surface of the second end of the locking member 110 is provided with the rack arranged in the radial direction of the flexible pull rod 109. The tooth block 112 configured to cooperate with the rack is fixed on the side table board 101.

When using the side table according to this embodiment, firstly, the first bent portion is adjusted to an appropriate height in the axial direction of the vertical tube 104, and then is adjusted to be at an appropriate angle in the circumferential direction of the vertical tube 104, and then the side table board 101 is adjusted to be at an appropriate angle in the circumferential direction of the second bent portion. Next, the cam lever 114 is pulled to pull the flexible pull rod 109 out of the bent tube 102. The flexible pull rod 109 brings the tapered pressing block 107 to push against the damping block 105, and the damping block 105 is moved towards the inside of the first bent portion till the damping block 105 is deformed to cooperate with the inner tube surface of the vertical tube 104, which stops the damping block 105, and fixes the first bent portion inside the vertical tube 104 in the axial direction and the circumferential direction of the vertical tube 104. Meanwhile, the flexible pull rod 109 brings the locking member 110 to push against the toothed block 112 and engage with the toothed block 112, which fixes the side table in the circumferential direction of the second bent portion. When retracting the side table according to this embodiment, the cam lever 114 is pulled reversely, which releases the flexible pull rod 109 back into the bent tube 102, thus the locking member 110 is disengaged from the toothed block 112, and the side table board 101 is unlocked in the circumferential direction of the second bent portion. Meanwhile, a distance between the locking member 110 and the damping block 105 along the passage of the bent tube 102 is shortened, the spring 108 is compressed by the locking member 110 and thus applying a force on the damping block 105 to push the damping block 105 away from the first bent portion, thus the damping block 105 is moved out of the first bent portion and the deformation of the damping block 105 is restored, which unlocks the first bent portion in the axial direction and the circumferential direction of the vertical tube 104.

In the side table according to this embodiment, the damping block 105 includes a deformable portion 152 and a mounting portion 151 fixedly connected to the deformable portion 152, and the mounting portion 151 is close to the flexible pull rod 109. In work, when the damping block 105 is compressed by the tapered pressing block 107, the deformable portion 152 is pushed against the end of the first bent portion and then is deformed to expand, thus a damping value between the damping block 105 and the vertical tube 104 is increased, which fixes the damping block 105 inside the vertical tube 104. After being compressed by the spring 108, the mounting portion 151 of the damping block 105 is moved outwards with respect to the first bent portion, which restores the deformation of the deformable portion 152, and the damping value becomes zero, therefore, the first bent portion is unlocked in the axial direction and the circumferential direction of the vertical tube 104.

Further, in the side table according to this embodiment, a position-limiting flange is provided at a periphery of an end, close to the deformable portion 152, of the mounting portion 151.

Further, in the side table according to this embodiment, a tapered end of the tapered pressing block 107 faces the damping block 105.

In the side table according to the above embodiments, the spring 108 may be an elastic hollow steel wire, and the flexible pull rod 109 may be a flexible steel wire. The vertical tube 104 is fixed to the chair frame via a fixing clip 103.

In a third embodiment, the first locking mechanism and the second locking mechanism are independent locking mechanisms, that is, the first locking mechanism and the second locking mechanism are respectively configured to fix the first bent portion in the axial direction and the circumferential direction of the vertical tube 104 and to fix the side table board 101 with respect to the second bent portion independently.

Figure 9:
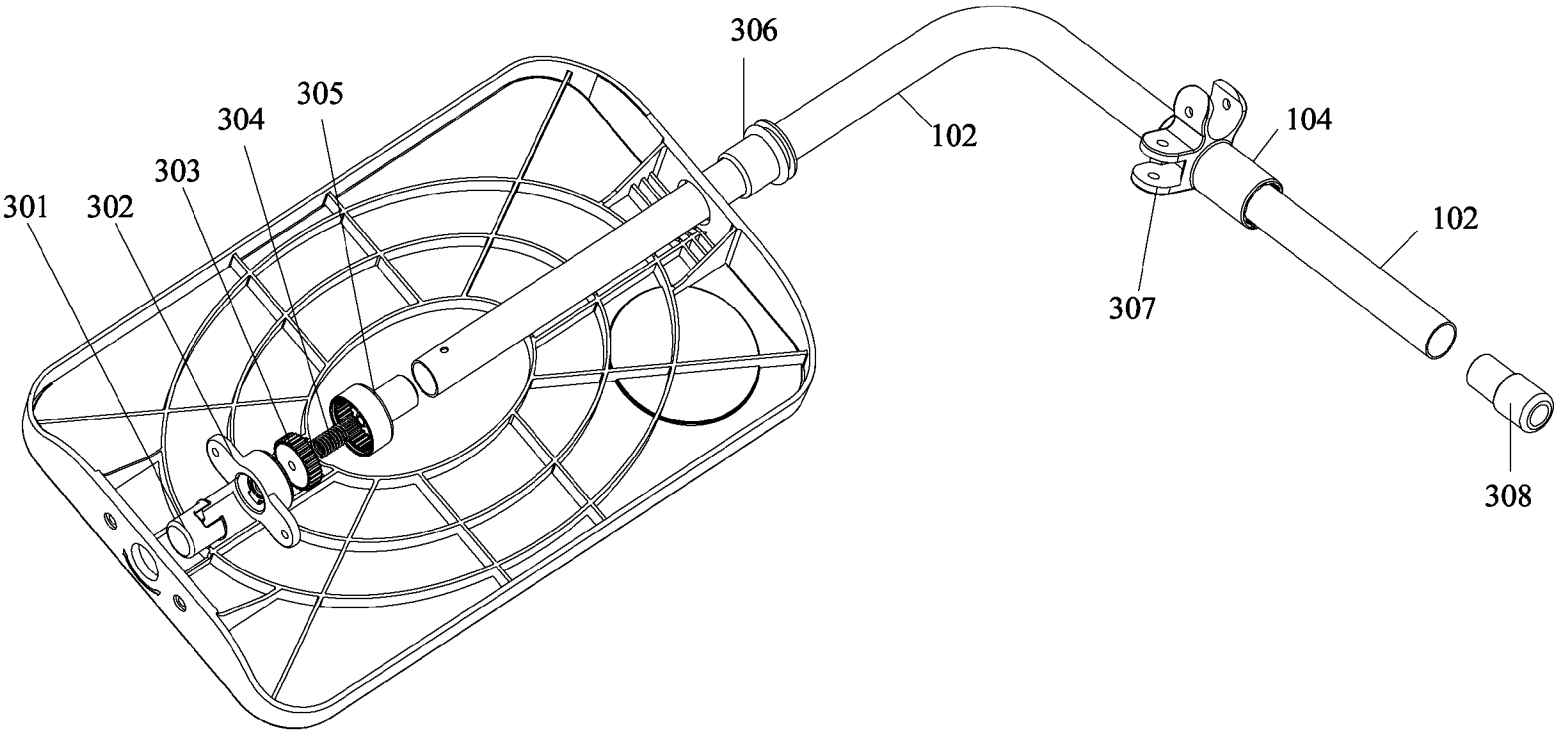
FIG. 9 is an exploded view of a third side table according to an embodiment of the present application.

As shown in FIG. 9, in this embodiment, the second locking mechanism includes a toothed wheel 303 arranged coaxially with the second bent portion, a fixing block 302 fixedly arranged on the side table board 101, a locking member 305 fixedly arranged at an end of the second bent portion, a spring 304, and a push button 301. The fixing block 302 is provided with a first receiving groove for receiving the toothed wheel 303, and a side wall of the first receiving groove is provided with internal teeth configured to cooperate with the toothed wheel 303. An end surface of the locking member 305 is provided with a second receiving groove, and a side wall of the second receiving groove is provided with internal teeth configured to cooperate with the toothed wheel 303. The spring 304 is arranged between the toothed wheel 303 and a bottom surface of the second receiving groove, and is abutted between the toothed wheel 303 and the bottom surface of the second receiving groove. The push button 301 is arranged at a side of the fixing block 302 away from the locking member 305, and is configured to push the toothed wheel 303 to cooperate with the internal teeth of the first receiving groove and the internal teeth of the second receiving groove. By pressing the push button 301, an extruding force is applied on the toothed wheel 303 by the push button 301, which pushes a portion of the toothed wheel 303 out of the first receiving groove, and in this case, the toothed wheel 303 cooperates with the internal teeth of the first receiving groove and the internal teeth of the second receiving groove at the same time, thereby fixing the locking member 305 and the fixing block 302 circumferentially. The fixing block 302 is fixedly connected to the side table board 101, and the locking member 305 is fixedly arranged on the second bent portion, thus the side table board 101 is fixed on the second bent portion. By adjusting the push button 301, the extruding force applied on the toothed wheel 303 by the push button 301 is removed, and the toothed wheel 303 returns into the first receiving groove under the action of the spring 304, and is not in cooperation with the internal teeth of the second receiving groove, thereby releasing the side table board 101 from being fixed to the second bent portion.

The fixing block 302 is arranged at s side of the side table board 101 away from the first bent portion, that is, the second bent portion passes through the side table board 101. For improving the stability of the rotation of the side table board 101, a tube casing 306 is provided at a side of the side table board 101 away from the fixing block 302.

Figure 10:
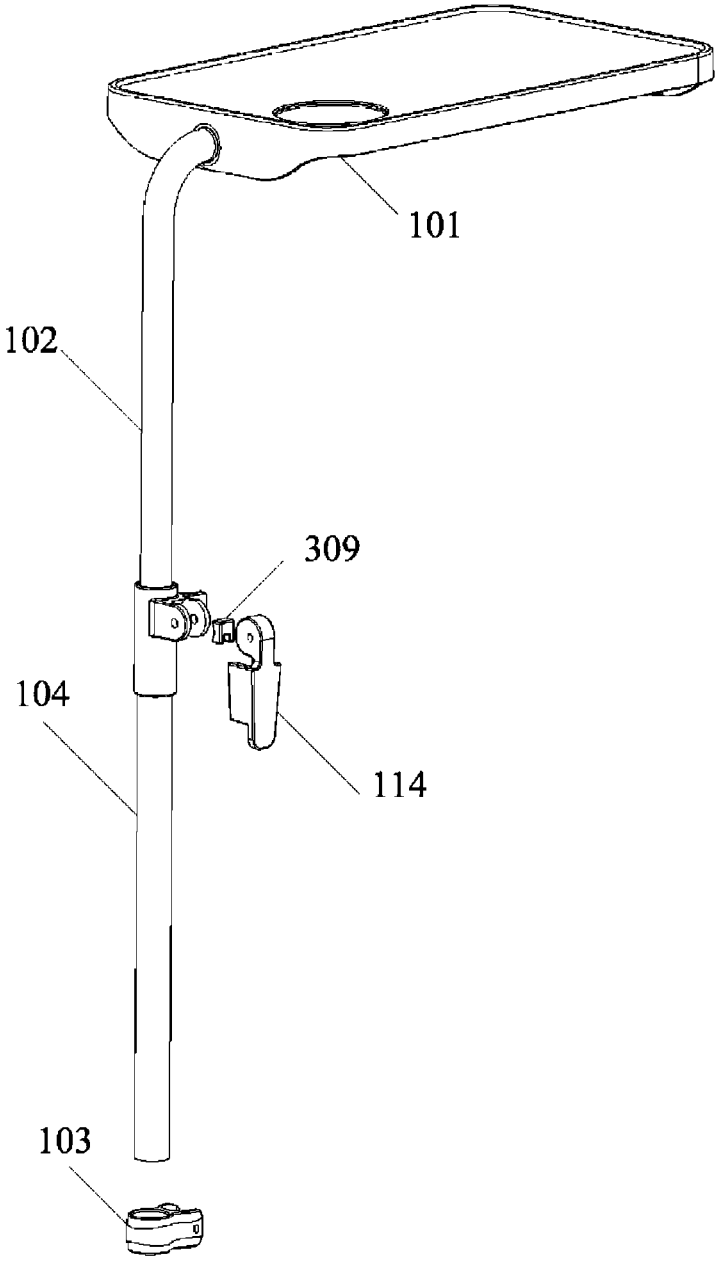
FIG. 10 is a structural view of the third side table according to the embodiment of the present application.

As shown in FIGS. 9 and 10, the first locking mechanism includes a cam lever 114 articulated to the vertical tube 104 via a rotation shaft; a through hole arranged on the vertical tube 104 at a position corresponding to a protruding portion of the cam lever 114, and a locking block 309 arranged in the through hole. The locking block 309 is located between a cam of the cam lever 114 and an outer wall of the first bent portion. By pulling the cam lever 114, the cam of the cam lever 114 presses the locking block 309 towards the outer wall of the first bent portion, thereby fixing the first bent portion in the axial direction and the circumferential direction of the vertical tube 104 by the friction force between the first bent portion and the locking block 309. When it is required to adjust the first bent portion in the axial direction and the circumferential direction of the vertical tube 104, the cam lever 114 is adjusted to move the cam away from the locking block 309, thus the friction force between the first bent portion and the locking block 309 is removed.

Further, the vertical tube 104 is provided with a mounting lug 307, and the cam lever is articulated to the mounting lug 307 via a rotation shaft. A guide block 308 is provided at an end of the first bent portion, to facilitate the smooth sliding of the first bent portion in the vertical tube 104.

The locking block 309 may also be not provided, that is, the first locking mechanism includes a cam lever articulated to the vertical tube 104 via a rotation shaft, and a through hole arranged on the vertical tube 104 at a position corresponding to a protruding portion of the cam lever. The maximum distance from the protruding portion to the rotation shaft is larger than a distance between the rotation shaft and the outer wall of the first bent portion. By pulling the cam lever, the protruding portion of the cam lever protrudes into the through hole to abut against the outer wall of the first bent portion, thereby fixing the first bent portion in the axial direction and the circumferential direction of the vertical tube 104 by the friction force between the protruding portion of the cam lever and the outer wall of the first bent portion.

The first locking mechanism may also have other structures. For example, the first locking mechanism includes a flexible pull rod 109 inserted in the first bent portion; a cam lever, a damping block, and a tapered pressing block. The cam lever is rotatably arranged on the vertical tube 104 and connected to a first end of the flexible pull rod 109, and is configured to pull the flexible pull rod along the bent tube when it is being pulled. The damping block has a first end inserted in an end of the first bent portion and a second end provided with a notch, and an outer periphery of the second end of the damping block is provided with external splines configured to cooperate with internal splines of the vertical tube. The tapered pressing block is arranged at a second end of the flexible pull rod and configured to push the second end of the damping block to expand to be in tight fit with the internal splines of the vertical tube. By pulling the cam lever, the first bent portion may also be fixed in the axial direction and the circumferential direction of the vertical tube 104, which will not be described herein.

A folding chair is further provided according to the present application, which includes a chair frame, and further includes a side table. Wherein, the side table is the side table according to the above embodiments.

In the folding chair, the chair frame may have various structures. The vertical tube 104 of the side table may be fixed to the chair frame constantly under the premise that the folding chair may be unfolded and folded normally, for example, the vertical tube 104 may be fixed to the chair frame as shown in FIG. 1 constantly. In a case that the chair frame cannot be unfolded and folded normally after the vertical tube 104 is assembled, the vertical tube 104 may be detachably arranged on the chair frame, that is, when it is required to use the side table, the vertical tube 104 may be fixed to the unfolded chair frame; and when the chair frame is to be folded, it is only required to remove the vertical tube 104 from the chair frame.

In addition, in the folding chair, the fixing position of the vertical tube 104 may be arranged according to the needs of the user, for example, the vertical tube 104 may be fixed to a front chair leg of the chair frame as shown in FIG. 1, to facilitate adjusting the height of the side table board 101. Correspondingly, when using this fixing method, the side table may be retracted according to the steps shown in FIGS. 4 to 7 in sequence.

The folding chair according to this embodiment is provided with the side table according to the above embodiments, thus having the function of providing a seat and supporting objects, and the side table is easy to use and easy to be retracted, thus it is convenient for the user. Apparently, the folding chair also has other effects of the side table according to the above embodiments, which will not be described herein.

The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A side table of a folding chair, comprising:

a vertical tube configured to be fixed to a chair frame of the folding chair;

a bent tube having a first bent portion and a second bent portion which are fixedly connected, and the first bent portion being inserted in the vertical tube;

a side table board rotatably arranged on the second bent portion;

a first locking mechanism configured to fix the first bent portion in an axial direction and a circumferential direction of the vertical tube; and a second locking mechanism configured to fix the side table board to the second bent portion, wherein the second locking mechanism comprises:

a toothed wheel coaxially arranged with the second bent portion;

a fixing block fixedly arranged on the side table board and having a first receiving groove for receiving the toothed wheel, wherein, a side wall of the first receiving groove is provided with internal teeth configured to cooperate with the toothed wheel;

a locking member fixedly arranged at an end of the second bent portion, wherein an end surface of the locking member is provided with a second receiving groove, and a side wall of the second receiving groove is provided with internal teeth configured to cooperate with the toothed wheel;

a spring provided between the toothed wheel and a bottom surface of the second receiving groove and being abutted between the toothed wheel and the bottom surface of the second receiving groove; and a push button arranged at a side, away from the locking member, of the fixing block, and configured to push the toothed wheel to allow the toothed wheel to cooperate with the internal teeth of the first receiving groove and the internal teeth of the second receiving groove.

2. The side table according to claim 1, wherein the first locking mechanism comprises:

a cam lever articulated to the vertical tube via a rotation shaft;

a through hole arranged in the vertical tube at a position corresponding to a protruding portion of the cam lever; and a locking block arranged in the through hole and located between a cam of the cam lever and an outer wall of the first bent portion.

3. A folding chair, comprising a chair frame, wherein the folding chair further comprises a side table, which comprises:

a vertical tube configured to be fixed to the chair frame of the folding chair;

a bent tube having a first bent portion and a second bent portion which are fixedly connected, and the first bent portion being inserted in the vertical tube;

a side table board rotatably arranged on the second bent portion;

a first locking mechanism configured to fix the first bent portion in an axial direction and a circumferential direction of the vertical tube; and a second locking mechanism configured to fix the side table board to the second bent portion, wherein the second locking mechanism comprises:

a toothed wheel coaxially arranged with the second bent portion;

a fixing block fixedly arranged on the side table board and having a first receiving groove for receiving the toothed wheel, wherein, a side wall of the first receiving groove is provided with internal teeth configured to cooperate with the toothed wheel;

a locking member fixedly arranged at an end of the second bent portion, wherein an end surface of the locking member is provided with a second receiving groove, and a side wall of the second receiving groove is provided with internal teeth configured to cooperate with the toothed wheel;

a spring provided between the toothed wheel and a bottom surface of the second receiving groove and being abutted between the toothed wheel and the bottom surface of the second receiving groove; and a push button arranged at a side, away from the locking member, of the fixing block, and configured to push the toothed wheel to allow the toothed wheel to cooperate with the internal teeth of the first receiving groove and the internal teeth of the second receiving groove.

* * * * *